US007907095B2

(12) United States Patent
Kimura et al.

(10) Patent No.: US 7,907,095 B2
(45) Date of Patent: Mar. 15, 2011

(54) ANTENNA DEVICE

(75) Inventors: Yuji Kimura, Ishikawa (JP); Yoshitaka Yoshino, Tokyo (JP); Koichi Mukai, Ishikawa (JP); Chisato Komori, Ishikawa (JP)

(73) Assignee: Sony Corporation, Tokyo (JP)

( * ) Notice: Subject to any disclaimer, the term of this patent is extended or adjusted under 35 U.S.C. 154(b) by 313 days.

(21) Appl. No.: 11/732,062

(22) Filed: Apr. 2, 2007

(65) Prior Publication Data

US 2008/0122711 A1 May 29, 2008

(30) Foreign Application Priority Data

Apr. 12, 2006 (JP) ..... 2006-109603

(51) Int. Cl.
*H01Q 1/12* (2006.01)
*H01Q 3/24* (2006.01)

(52) U.S. Cl. ..... 343/718; 343/745

(58) Field of Classification Search ..... 343/745, 343/876, 904, 729–730, 790–791, 718
See application file for complete search history.

(56) References Cited

U.S. PATENT DOCUMENTS

| | | | | |
|---|---|---|---|---|
| 6,078,295 | A * | 6/2000 | Rawle | 343/730 |
| 7,053,843 | B2 * | 5/2006 | Nysen | 343/702 |
| 2006/0014560 | A1 * | 1/2006 | Yoshino | 455/550.1 |

FOREIGN PATENT DOCUMENTS

| | | |
|---|---|---|
| JP | 2005-348252 | 5/1993 |
| JP | 2006-041826 | 6/1999 |
| JP | 2005-333613 | 12/2005 |
| JP | 2005-354275 | 12/2005 |
| WO | WO 2006/092913 * | 9/2006 |

* cited by examiner

*Primary Examiner* — Huedung Mancuso
(74) *Attorney, Agent, or Firm* — Robert J. Depke; Rockey, Depke & Lyons, LLC

(57) ABSTRACT

Disclosed herein is an antenna device for receiving a broadcast wave in each of a first required frequency band and a second required frequency band, the antenna device including: an earphone cable including an audio signal line and a ground line; and an antenna element cable including a coaxial line formed by covering a core line with an insulator and further covering the insulator with an outer covering conductor, and an audio signal line, a leading end of the antenna element cable being connected to the earphone cable via a relay circuit, and a base end of the antenna element cable being connected to a device including a tuner via an antenna switching circuit.

13 Claims, 8 Drawing Sheets

ANTENNA DEVICE

CROSS REFERENCES TO RELATED APPLICATIONS

The present invention contains subject matter related to Japanese Patent Application JP 2006-109603 filed in the Japan Patent Office on Apr. 12, 2006, the entire contents of which being incorporated herein by reference.

BACKGROUND OF THE INVENTION

1. Field of the Invention

The present invention relates to an antenna device for receiving broadcast waves, and particularly to an antenna device for receiving terrestrial digital broadcasts by a portable device used in a state of being worn by a human body.

More specifically, the present invention relates to an antenna device formed by utilizing a cable for transmitting audio signals to earphones, and particularly to an antenna device that has excellent antenna characteristics in both a VHF band and a UHF band.

2. Description of the Related Art

The service of terrestrial digital broadcasting using a terrestrial UHF band (470 MHz to 890 MHz) started in three major wide areas, that is, the Kanto area, the Kinki area, and the Chukyo area on Dec. 1, 2003. Terrestrial digital broadcasting can provide high-definition television programs of high image quality and high sound quality as well as interactive programs. Terrestrial digital broadcasts can be received by a UHF antenna, and can be received and viewed clearly without flicker even by a television installed in a running train or bus, for example. In addition, a service is planned which allows simple moving pictures, data broadcasts, and audio broadcasts to be received and viewed by a portable information terminal or the like.

While terrestrial digital broadcasting is a broadcasting system that performs transmission with a band of six megahertz divided into 13 segments, a one-segment partial reception service, or a so-called "one-seg" service, which distributes video, audio, and data for portable telephones and mobile terminals by only one central segment of the 13 segments, is scheduled to be started on Apr. 1, 2006 (Saturday), and is drawing attention. The one-seg program service provides basically the same contents as programs for ordinary television receivers which programs are distributed by using the 12 segments. Therefore popular programs usually viewed by a user on a television installed in a house can be enjoyed while the user is out. As receiving terminals, various receivers such as portable telephones, car navigation systems, personal computers, dedicated portable televisions and the like are expected to appear.

In addition, terrestrial digital radio broadcasting started on Oct. 10, 2003. One distribution system of terrestrial digital radio broadcasting is a three-segment-based digital broadcasting in which a seventh channel in a current VHF band (188 MHz to 200 MHz) is divided into eight segments and one channel is composed of three of the eight segments. This system enables a wide variety of service of audio, simple picture, and data broadcasts, and enables not only indoor reception but also clear reception by a vehicle-mounted receiver such as a car radio or the like and a portable receiver of a pocket type or the like.

As receiving antenna for relatively small broadcast wave receiving devices, rod antennas are widely used, and telescopic rod antennas, helical antennas and the like are known. When terrestrial digital broadcasting for portable devices spreads, highly sensitive reception performance needs to be secured to deal flexibly with various viewing modes. The present inventors et al. consider that a method of forming a receiving antenna is one important technical problem especially when a portable device includes a multiple tuner for different required frequency bands of FM radio broadcasting using a VHF band and terrestrial digital TV broadcasting using a UHF band, for example.

It is known in the art that an earphone cable is coupled with an antenna circuit and the earphone cable is used as a wire antenna for a portable radio device. An earphone antenna of this type makes it possible to realize a broadcast receiving antenna with high portability by a relatively simple configuration and incorporate an antenna of an inconspicuous design without hampering efforts to meet needs for lighter weight, smaller size, and portability.

For example, an earphone-microphone has been proposed in which when a cord connecting the earphone-microphone and a portable telephone with each other is formed by a parallel two-core cable composed of a pair of an acoustic signal line and a ground line, the ground line is utilized as an antenna, whereby the whole of the earphone cable is used as antenna (see Japanese Patent Laid-open No. 2005-354275, for example).

In addition, an earphone antenna has been proposed which functions as a dipole antenna and obtains high gain over a wide band (see Japanese Patent Laid-open No. 2005-333613, for example). This earphone antenna includes a shield cable having one end connected to a main body of a radio set via a multipolar connector and an earphone cable connected to another end of the shield cable via a connecting block. The earphone cable is formed by two insulation-coated signal lines for supplying audio signals to earphones. The shield cable includes a coaxial line formed by covering a central conductor transmitting a high-frequency signal with an insulator and further covering the insulator with a shield line, insulation-coated signal lines and an insulation-coated ground line for audio signals, and a shield line covering the outside of the coaxial line, the signal lines, and the ground line with an insulator between the shield line and the outside of the coaxial line, the signal lines, and the ground line. The signal lines and the ground line for audio signals are connected to the earphone cable via high-frequency chokes each having a low impedance in a frequency region of the audio signals and having a high impedance in a frequency region of the high-frequency signal, whereby transmission lines for the audio signals are formed. The earphone antenna uses the earphone cable and the shield line covering the shield cable as an aerial, the earphone cable and the shield line being connected to the coaxial line via a balun. The earphone antenna thus has a dipole antenna structure resonating at line length of the aerial. The length of each of the earphone cable and the shield line is adjusted so as to receive 100 MHz in the VHF band.

This earphone antenna resonates at 100 MHz and is able to perform reception at 200 MHz as 1-λ antenna when the characteristic impedance of the coaxial line is adjusted to 75Ω, the length of the shield cable is adjusted to 70 cm, and the length of the earphone cable is adjusted to 50 cm. While it suffices to use harmonic excitation (third harmonics, fifth harmonics, and seventh harmonics) of 100 MHz and 200 MHz in the UHF band, the earphone antenna is basically an antenna element ready for the VHF band. The VHF band and the UHF band are rather distant from each other on a frequency axis, and thus it is difficult to satisfy respective antenna characteristics of the VHF band and the UHF band simultaneously.

Alternatively, a central conductor of a coaxial line within a shield cable is connected to one signal line of an earphone cable, and connected to another signal line of the earphone cable via a capacitor having a high impedance in a frequency region of audio signals and having a low impedance in a frequency region of a high-frequency signal. Signal lines for the audio signals on the shield cable side are respectively connected to two signal lines on the earphone cable side via high-frequency chokes having a low impedance in the frequency region of the audio signals and having a high impedance in the frequency region of the high-frequency signal, whereby transmission lines for the audio signals are formed. A shield line covering the outside of the coaxial line and audio signal lines within the shield cable is connected to a ground. The earphone cable and the shield line are used as an aerial and operate as a sleeve antenna structure resonating at a line length of the aerial. The length of each of the earphone cable and the shield line is adjusted so as to receive 100 MHz in the VHF band (see Japanese Patent Laid-open No. 2005-348252, for example).

This earphone antenna resonates at 100 MHz and is able to perform reception at 200 MHz as 1-λ antenna when the characteristic impedance of the coaxial line is adjusted to 75Ω, the length of the shield cable is adjusted to 70 cm, and the length of the earphone cable is adjusted to 50 cm. While it suffices to use harmonic excitation (third harmonics, fifth harmonics, and seventh harmonics) of 100 MHz and 200 MHz in the UHF band, the earphone antenna is basically an antenna element ready for the VHF band. The VHF band and the UHF band are rather distant from each other on a frequency axis, and thus it is difficult to satisfy respective antenna characteristics of the VHF band and the UHF band simultaneously.

For example, while it is possible to include both a receiving antenna for the VHF band and a receiving antenna for the UHF band, the inclusion of both a receiving antenna for the VHF band and a receiving antenna for the UHF band may not solve problems of space saving and size reduction. While each receiving antenna may be made detachable to allow a user to change and use the receiving antennas as appropriate, changing the receiving antennas and carrying the receiving antennas are troublesome. In addition, a number of parts are required by a matching circuit after switching a plurality of antennas or a single antenna, thus inviting an increase in mounting area and an increase in cost.

Further, a portable telephone has been proposed which has a plurality of broadcast receiving circuits and selects a demodulated signal of higher quality, so that high reception sensitivity can be obtained in any use conditions (see Japanese Patent Laid-open No. 2006-41826, for example). In this portable telephone, a loop element is disposed in the vicinity of a hinge part of an upper casing, and is connected to a broadcast receiving circuit via a matching circuit. When an earphone cable is removed, a helical element is selected by an earphone connector. A received signal of the antenna selected by the earphone connector is input to a broadcast receiving circuit. However, this portable telephone does not perform an operation of receiving broadcast waves in a plurality of required frequency bands.

SUMMARY OF THE INVENTION

It is desirable to provide an excellent antenna device for receiving terrestrial digital broadcasts by a portable device used in a state of being worn by a human body.

It is also desirable to provide an excellent antenna device formed by utilizing a cable for transmitting audio signals to earphones.

Further, it is desirable to provide an excellent antenna device that has good antenna characteristics in both the VHF band and the UHF band.

According to an embodiment of the present invention, there is provided an antenna device for receiving a broadcast wave in each of a first required frequency band and a second required frequency band, the antenna device including: an earphone cable including an audio signal line and a ground line; and an antenna element cable including a coaxial line formed by covering a core line with an insulator and further covering the insulator with an outer covering conductor, and an audio signal line, a leading end of the antenna element cable being connected to the earphone cable via a relay board, and a base end of the antenna element cable being connected to a device including a tuner via an antenna switching circuit; wherein the relay board connects the core line of the coaxial line to the ground line on a side of the earphone cable, and sets the outer covering conductor of the coaxial line in a non-connected state, and the antenna switching circuit performs switching to make the core line of the coaxial line transmit a high-frequency signal in an operation mode in which reception is performed in the first required frequency band, whereby the earphone cable and the core line of the coaxial line are used as an aerial and operate as a sleeve antenna structure resonating at a line length of the aerial, and the antenna switching circuit performs switching to make the outer covering conductor of the coaxial line transmit a high-frequency signal in an operation mode in which reception is performed in the second required frequency band, whereby the outer covering conductor of the coaxial line is used as an aerial and operates as a monopole antenna structure resonating at a line length of the aerial.

As the service of terrestrial digital broadcasting for portable devices has started, a method of forming a receiving antenna for portable devices is one important technical problem. For example, an earphone antenna is known which is formed by coupling an earphone cable with an antenna circuit. The earphone antenna makes it possible to incorporate the antenna of an inconspicuous design without hampering efforts to meet needs for lighter weight, smaller size, and portability.

Terrestrial digital broadcasting providing service for portable devices includes FM radio broadcasting using the VHF band and terrestrial digital TV broadcasting using the UHF band. The VHF band and the UHF band are rather distant from each other on a frequency axis, and thus it is difficult for the earphone antenna to satisfy respective antenna characteristics of the VHF band and the UHF band simultaneously.

On the other hand, the antenna device according to the above-described embodiment of the present invention is formed by connecting an earphone cable including an audio signal line and a ground line to an antenna element cable using a coaxial cable by a relay board. The antenna device changes a feeding point for feeding to the antenna element cable according to which of a first required frequency band and a second required frequency band to receive, and thereby selectively operates as a sleeve antenna structure or a monopole antenna structure.

Specifically, in the relay board, the core line of the coaxial line is connected to the ground line on a side of the earphone cable, and the outer covering conductor of the coaxial line is set in a non-connected state. The antenna switching circuit makes one of the core line and the outer covering conductor of the coaxial line selectively transmit a high-frequency signal. Specifically, in an operation mode in which reception is performed in the first required frequency band, the antenna switching circuit performs switching to make the core line of the coaxial line transmit a high-frequency signal, whereby the earphone cable and the core line of the coaxial line are used as an aerial and operate as a sleeve antenna structure resonating at a line length of the aerial. On the other hand, in an operation mode in which reception is performed in the second required frequency band, the antenna switching circuit performs switching to make the outer covering conductor of the coaxial line transmit a high-frequency signal, whereby the outer covering conductor of the coaxial line is used as an aerial and operates as a monopole antenna structure resonating at a line length of the aerial.

The first required frequency band is a UHF band, and excellent antenna characteristics can be obtained by an earphone antenna of the sleeve antenna structure. The second required frequency band is a VHF band, and excellent antenna characteristics can be obtained by an earphone antenna of the monopole antenna structure.

In this case, the relay board has a high-frequency choke loaded on the audio signal line, the high-frequency choke having a low impedance in a frequency band of an audio signal and a high impedance in a frequency band of a high-frequency signal. The relay board can thereby form a transmission line for an excellent audio signal from which a high-frequency component is removed. Ferrite beads are widely known as an anti-EMI part that reduces a signal as a source causing radiation noise, using frequency characteristics of an impedance component of a ferrite material as a complex compound of ferrite and metal (the ferrite material increases the impedance component as frequency is raised).

The antenna switching circuit has a capacitor loaded on each of signal lines for the core line and the outer covering conductor of the coaxial line, the capacitor having a high impedance in a frequency band of an audio signal and a low impedance in one of the first required frequency band and the second required frequency band, and connects the signal lines to a side of the tuner. Therefore the earphone antenna forms an excellent aerial when used as each of the sleeve antenna structure and the monopole antenna structure.

In addition, within the antenna element cable, the audio signal line may be disposed outside the coaxial cable. For example, the audio signal line may be wound around the periphery of the coaxial cable. Alternatively, within the antenna element cable, the audio signal line can be formed as an insulation-coated signal line, and can be formed together with the core line as a coaxial cable covered by the insulator and the outer covering conductor.

Further, according to a second embodiment of the present invention, there is provided a receiving terminal including: an inserting unit into which an antenna element cable is detachably inserted, the antenna element cable including a coaxial line formed by covering a core line with an insulator and further covering the insulator with an outer covering conductor, and an audio signal line, a leading end of the antenna element cable being connected to an earphone cable including an audio signal line and a ground line via a relay board, the relay board connecting the core line of the coaxial line to the ground line on a side of the earphone cable, and setting the outer covering conductor of the coaxial line in a non-connected state; turners for performing receiving operation in a first required frequency band and a second required frequency band, respectively; and an antenna switching circuit for changing constitution of an antenna formed by the earphone cable and the antenna element cable by changing a feeding position in the inserting unit according to which of the turners performs the receiving operation.

In a concrete method of manufacturing the antenna device according to the above-described embodiment of the present invention, a base end of the earphone antenna is formed by a multipolar plug and is allowed to be inserted into and detached from a multipolar jack disposed in the relay board on the antenna cable side, and a base end of the antenna cable is formed by a multipolar plug. Then, the antenna switching circuit is included in the receiving terminal including the turners performing receiving operation in the first required frequency band and the second required frequency band, respectively, and the antenna cable is detachably inserted into the receiving terminal.

In such a case, the antenna switching circuit included in the tuner device automatically changes the feeding position for feeding to the multipolar plug according to a required frequency band in which to resonate, whereby one of the sleeve antenna structure and the monopole antenna structure can be formed. A user does not need to be conscious of anything at all except for connecting the antenna element cable and the earphone cable to each other.

In addition, because the earphone cable part serving as an element of the sleeve antenna has an ordinary constitution, the user can attach a desired earphone cable to the antenna element cable.

Further, the antenna switching circuit for changing the antenna constitution is included in the tuner device rather than being disposed on the earphone cable or the antenna element cable, so that the external appearance of the device is improved.

According to the present invention, it is possible to provide an excellent antenna device that makes it possible to receive terrestrial digital broadcasts by a portable device used in a state of being worn by a human body, utilizing a cable for transmitting audio signals to earphones as an aerial.

According to the present invention, it is possible to provide an excellent antenna device that is formed as one earphone antenna and which has good antenna characteristics in both the VHF band and the UHF band.

The antenna device according to the above-described embodiment of the present invention can obtain antenna characteristics for the two required frequency bands by one antenna element, and eliminates a need for a matching circuit and the like. The antenna device can therefore contribute to space saving, thickness reduction, and cost reduction required of mobile terminals such as portable telephones and the like.

In addition, the antenna switching circuit of the antenna device according to the above-described embodiment of the present invention is included in the tuner device, and the tuner device side automatically changes the feeding position according to a required frequency band in which to resonate, whereby one of the sleeve antenna structure and the monopole antenna structure can be formed. A user does not need to be conscious of anything at all when changing a channel of the tuner except for connecting the antenna element cable and the earphone cable to each other. The user can attach a desired earphone cable to the antenna element cable.

Other and further features and advantages of the present invention will become apparent from more detailed description on the basis of embodiments of the present invention to be described later and the accompanying drawings.

DETAILED DESCRIPTION OF THE PREFERRED EMBODIMENTS

Preferred embodiments of the present invention will hereinafter be described in detail with reference to the drawings.

Figure 1:
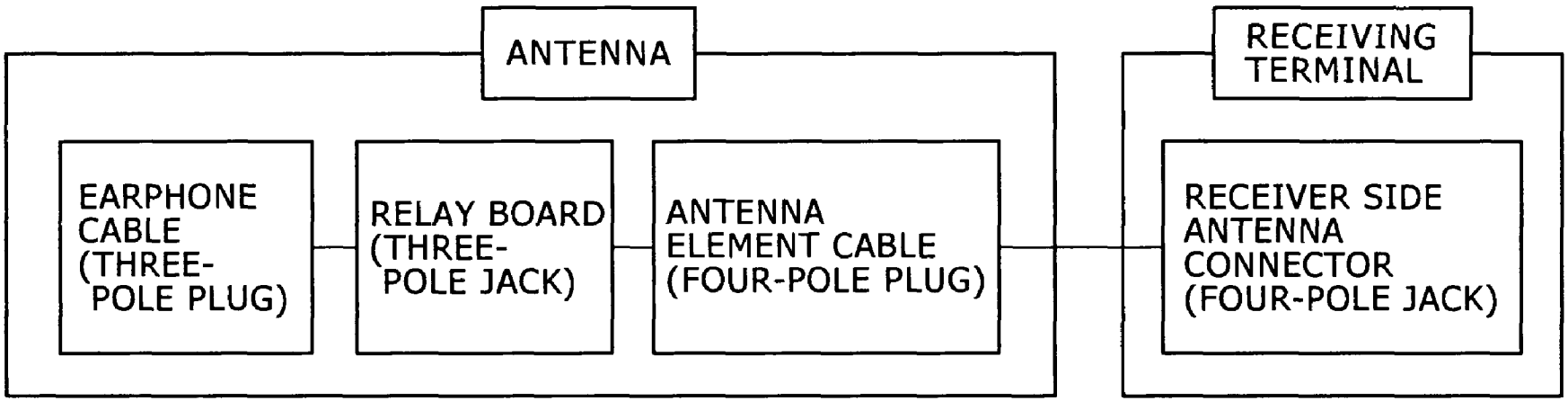
FIG. 1 is a diagram schematically showing a basic configuration of an antenna element part of an antenna device to which an embodiment of the present invention is applied.

FIG. 1 schematically shows a basic configuration of an antenna element part of an antenna device to which the present invention is applied. The antenna part shown in FIG. 1 is formed by two parts, that is, an earphone cable and an antenna element cable. Earphones have a three-pole plug at a base end thereof. A relay board including a three-pole jack for receiving the three-pole plug is disposed at a leading end of the antenna element cable. A base end of the antenna element cable is formed by a four-pole plug, and can be inserted into a four-pole jack of a receiving terminal (to be described later) including tuners.

Figure 2:
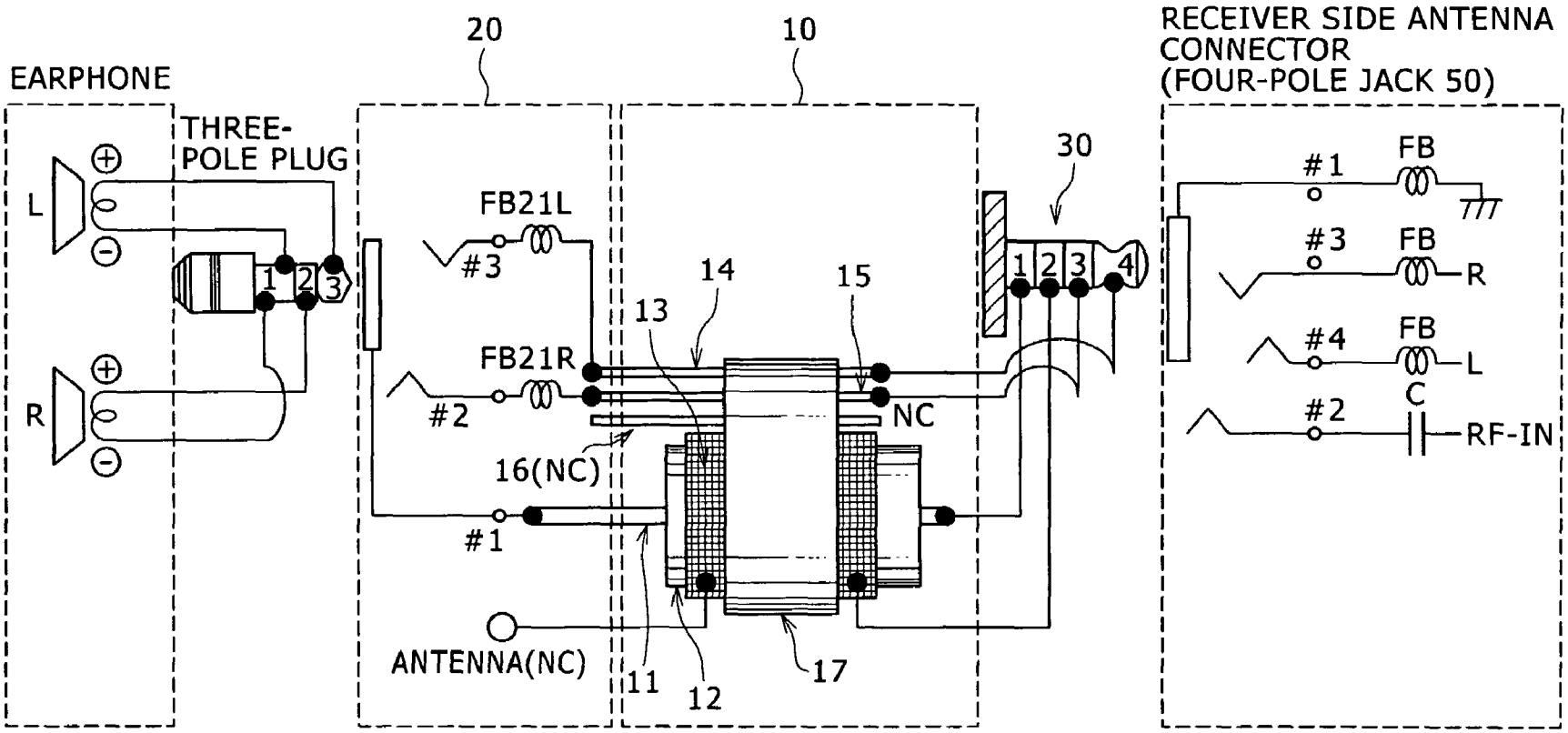
FIG. 2 is a diagram showing an example of circuit configuration of the antenna device shown in FIG. 1 and the periphery of the antenna device.

FIG. 2 shows an example of circuit configuration of the antenna device shown in FIG. 1 and the periphery of the antenna device.

The earphone cable is formed by bundling together three signal lines running in parallel with each other, that is, two insulation-coated audio signal lines for supplying an audio signal to a left earphone and a right earphone, and a ground line. At the base end of the earphone cable, the ground line and the right and left audio signal lines are assigned to pins #1, #2, and #3, respectively, of the three-pole plug.

The antenna element cable 10 includes a coaxial cable formed by covering a core line 11 with an inside insulator 12 and further covering the inside insulator 12 with an outer covering conductor 13, a plurality of signal lines including two audio signal lines 14 and 15 for the left and right audio signals, and an outer covering insulator 17 covering the outside of the coaxial cable and the plurality of signal lines. The plurality of signal lines 14 to 16 including the audio signal lines are formed by insulated wire, and wound around the coaxial cable, for example. The unused signal line 16 is in a non-connected (NC) state at both ends. A shielded cable disclosed in Japanese Patent Laid-Open No. 2005-122937, for example, can be used as the antenna element cable 10 proper.

The relay board 20 including the three-pole jack for receiving the three-pole plug of the earphone cable is disposed at the leading end of the antenna element cable 10. The relay board 20 has high-frequency chokes 21L and 21R loaded on a left audio signal line and a right audio signal line connected to the pins #1 and #2 of the three-pole plug, the high-frequency chokes 21L and 21R having a low impedance in a frequency region of the audio signals and having a high impedance in a frequency region of high-frequency signals. The high-frequency chokes can be formed by ferrite beads (FB), for example. The ferrite beads are widely known as an anti-EMI (electromagnetic interference) part that reduces a signal as a source causing radiation noise, using frequency characteristics of an impedance component of a ferrite material as a complex compound of ferrite and metal. The ferrite material increases the impedance component as frequency is raised. In addition, the relay board 20 connects the core line 11 of the coaxial cable to the earphone cable side via the pin #3 of the three-pole plug, and the outer covering conductor 13 of the coaxial cable is set in a non-connected (NC) state in the relay board 20.

The present inventors et al. consider that the coaxial cable is suitable as an antenna element cable also serving as an earphone cable because the coaxial cable has a characteristic impedance of 75Ω or 50Ω with little attenuation, has a structure in which a low-frequency signal and a high-frequency signal do not interfere with each other, and meets a predetermined standard for bending characteristics.

When a feeding position is set so as to make the core line 11 of the coaxial cable transmit a high-frequency signal, the ground signal line within the earphone cable and the core line 11 of the coaxial cable are used together as an aerial and operate as a sleeve antenna structure resonating at a line length of the aerial, so that a UHF band (470 MHz to 770 MHz) can be received.

On the other hand, when the feeding position is set so as to make the outer covering conductor 13 of the coaxial cable transmit a high-frequency signal, the outer covering conductor 13 of the coaxial cable is used as an aerial and operates as a monopole antenna structure resonating at a line length of the aerial, so that a VHF band or an FM radio band (70 MHz to 90 MHz) can be received. In this case, exerting a shield effect in a low-frequency band of about 20 kHz in which audio signals are transmitted, the core line 11 of the coaxial cable operates as an excellent ground for the earphone cable, while the outer covering conductor 13 can operate as an antenna in the VHF band higher than 70 MHz in which the outer covering conductor 13 transmits received broadcast waves. The monopole antenna has half a length (that is, $\lambda/4$) of the dipole antenna, so that the monopole antenna can be made relatively small.

A four-pole plug 30 to be inserted into the receiving terminal, that is, the tuner side is disposed at the base end of the antenna element cable 10. Pins #4, #3, and #1 of the four-pole plug 30 are respectively assigned to the left audio signal line, the right audio signal line, and the core line 11 of the coaxial cable as ground line. A pin #2 as an extra as compared with the three-pole plug of the earphone cable is assigned to the outer covering conductor 13 of the coaxial cable. When the antenna device operates as a sleeve antenna, the core line 11 of the coaxial cable and the ground line of the earphone cable constitute an antenna element. When the antenna device operates as a monopole antenna, the outer covering conductor 13 of the coaxial cable forms an antenna element.

Figure 3:
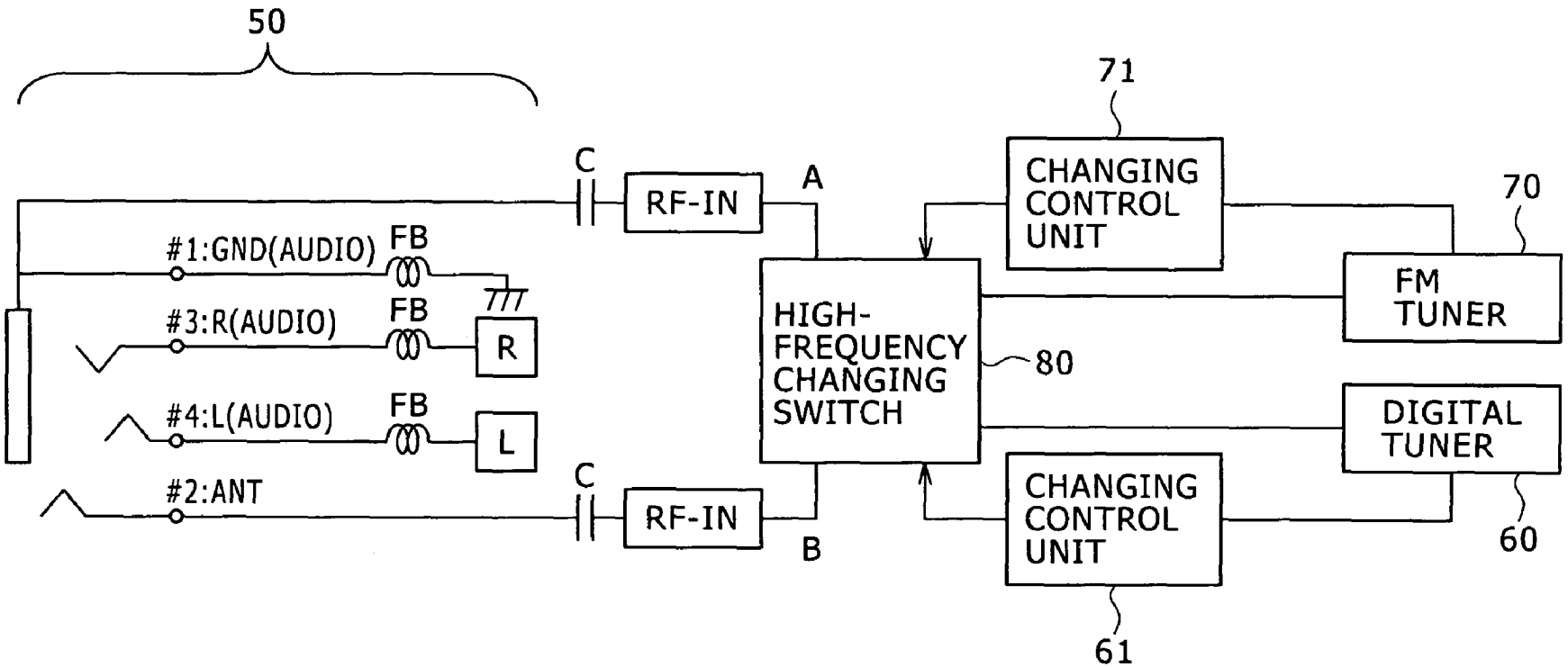
FIG. 3 is a diagram showing an example of configuration of a tuner peripheral circuit of a receiving terminal into which an antenna element shown in FIG. 2 can be inserted.

FIG. 3 shows an example of configuration of a tuner peripheral circuit of the receiving terminal into which the antenna element shown in FIG. 2 can be inserted.

The receiving terminal side including tuners has a four-pole jack 50 for receiving the four-pole plug 30 at the base end of the antenna element cable 10. The four-pole jack 50 has pins #4, #3, and #1 assigned to connect the ground line and the right and left audio signal lines possessed by the pins #1 to #3 of the three-pole plug of the earphone cable when the earphone cable is inserted. The four-pole jack 50 has another pin #2 assigned to an antenna element when the antenna element cable 10 is inserted.

In addition, the tuner side has high-frequency chokes (ferrite beads: FB) respectively loaded on the transmission lines for transmitting the left and right audio signal lines and the ground line, the high-frequency chokes having a low impedance in a frequency region of audio signals and having a high impedance in a frequency region of high-frequency signals. Further, capacitors C having a high impedance in the frequency region of the audio signals and having a low impedance in the frequency region of the high-frequency signals are respectively loaded on the transmission lines for transmitting antenna received signals received from the core line 11 and the outer covering conductor 13. The antenna element shown in FIG. 2 can be switched to the sleeve antenna structure or the monopole antenna structure according to which of the pin #1 and the pin #4 of the four-pole plug 30 is set as a feeding point of the antenna element in the four-pole jack 50.

The receiving terminal includes: a digital tuner 60 for receiving terrestrial digital broadcast waves using the UHF band; an FM tuner 70 for receiving FM radio broadcast waves using the VHF band; a high-frequency changing switch 80 for changing the feeding position for the antenna element cable 10 in the four-pole jack 50; and changing control units 61 and 71 for controlling the changing operation of the high-frequency changing switch 80.

On the receiving terminal side, the changing control units 61 and 71 automatically change the feeding position for feeding to the four-pole plug 30 according to a status of receiving operation of the digital tuner 60 or the FM tuner 70, whereby one of the sleeve antenna structure and the monopole antenna structure can be formed. A user does not need to be conscious of anything at all except for connecting the antenna element cable and the earphone cable to each other.

In addition, because the earphone cable part serving as an element of the sleeve antenna has an ordinary constitution, the user can attach a desired earphone cable to the antenna element cable.

Further, the antenna changing circuit for changing the antenna configuration is included in the tuner device rather than being disposed on the earphone cable or the antenna element cable, so that the external appearance of the device is improved.

When the digital tuner 60 performs receiving operation, the changing control unit 61 controls the changing operation of the high-frequency changing switch 80 to set the pin #1 of the four-pole plug 30 as an antenna feeding point. In this case, the ground signal line within the earphone cable and the core line 11 of the coaxial cable are used together as an aerial and operate as a sleeve antenna structure resonating at a line length of the aerial, so that the digital tuner 60 can receive a high-frequency signal in the UHF band from the core line 11 of the coaxial cable.

On the other hand, when the FM tuner 70 performs receiving operation, the changing control unit 71 controls the changing operation of the high-frequency changing switch 80 to set the pin #2 of the four-pole plug 30 as an antenna feeding point. In this case, the outer covering conductor 13 of the coaxial cable is used as an aerial and operates as a monopole antenna structure resonating at a line length of the aerial, so that the FM tuner 70 can receive a high-frequency signal in the FM radio band (70 MHz to 90 MHz) from the outer covering conductor 13 of the coaxial cable.

Figure 4:
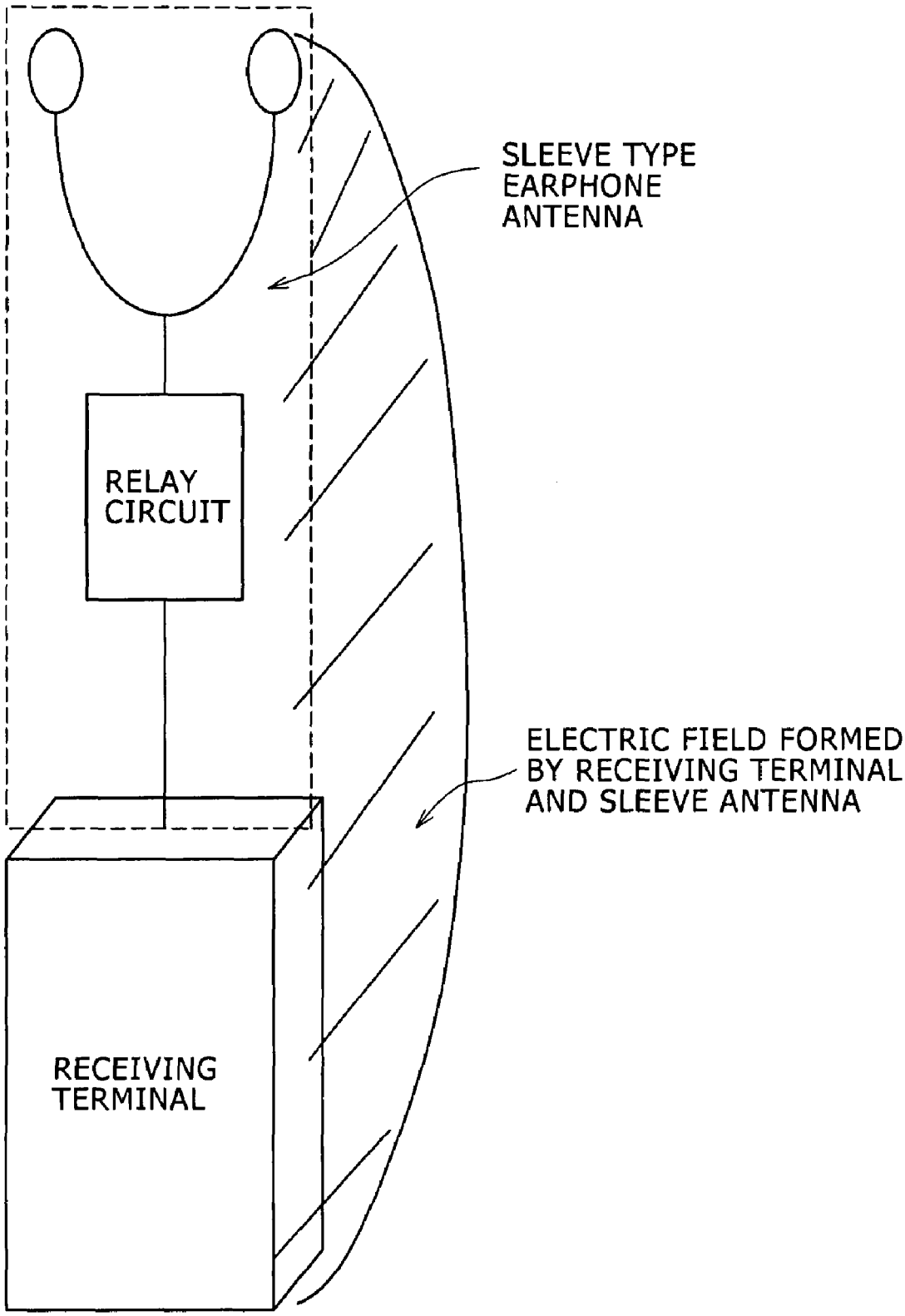
FIG. 4 is a diagram showing an operation when the antenna device shown in FIG. 2 forms a sleeve antenna.

FIG. 4 shows an operation when the antenna device according to the present embodiment forms a sleeve antenna. In this case, the receiving operation is performed by an electric field formed by the receiving terminal proper and the sleeve antenna composed of the earphone cable and the antenna element cable.

Figure 5:
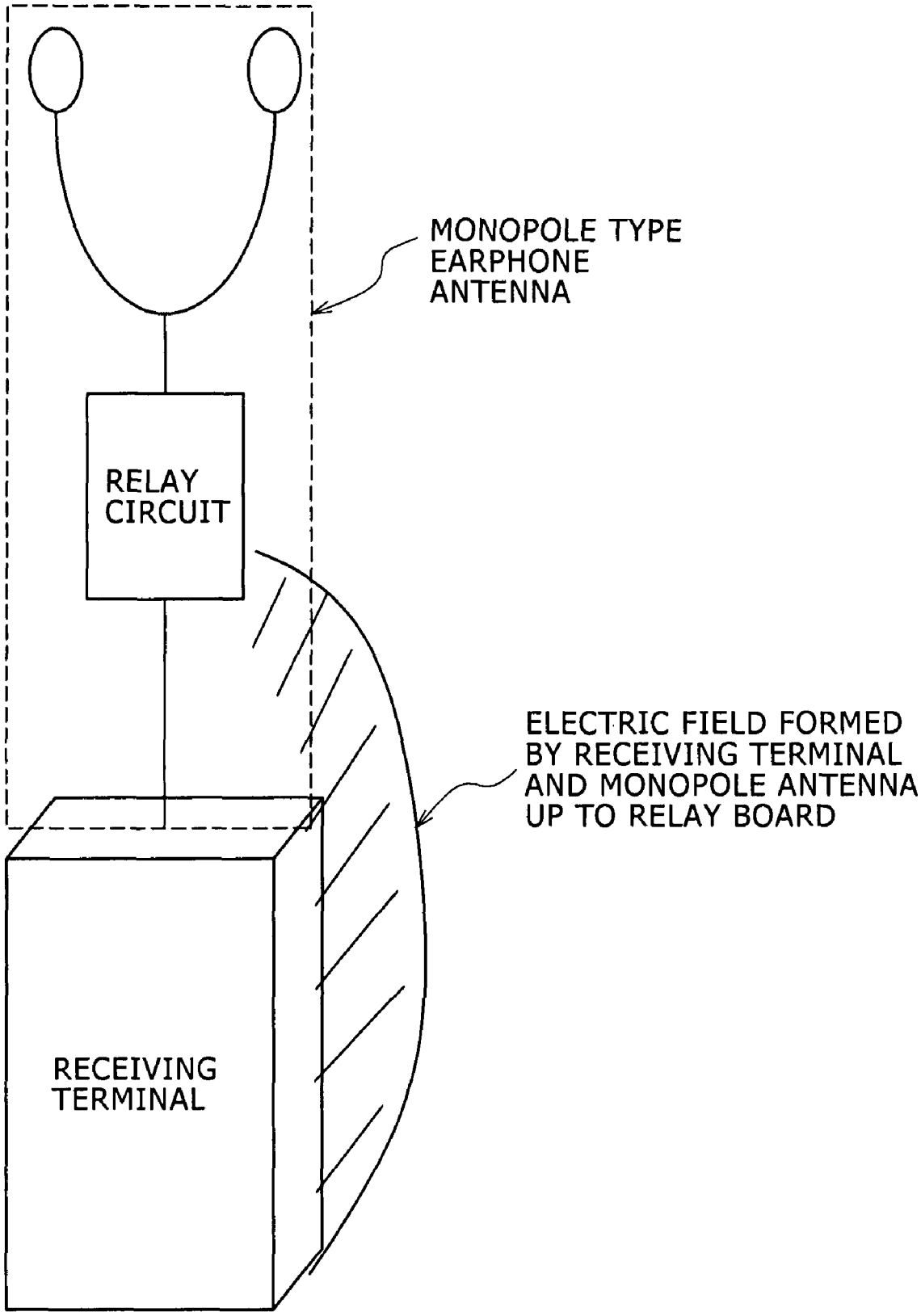
FIG. 5 is a diagram showing an operation when the antenna device shown in FIG. 2 forms a monopole antenna.

FIG. 5 shows an operation when the antenna device according to the present embodiment forms a monopole antenna. In this case, the receiving operation is performed by an electric field formed by the receiving terminal proper and the monopole antenna formed by the antenna element cable.

Figure 6:
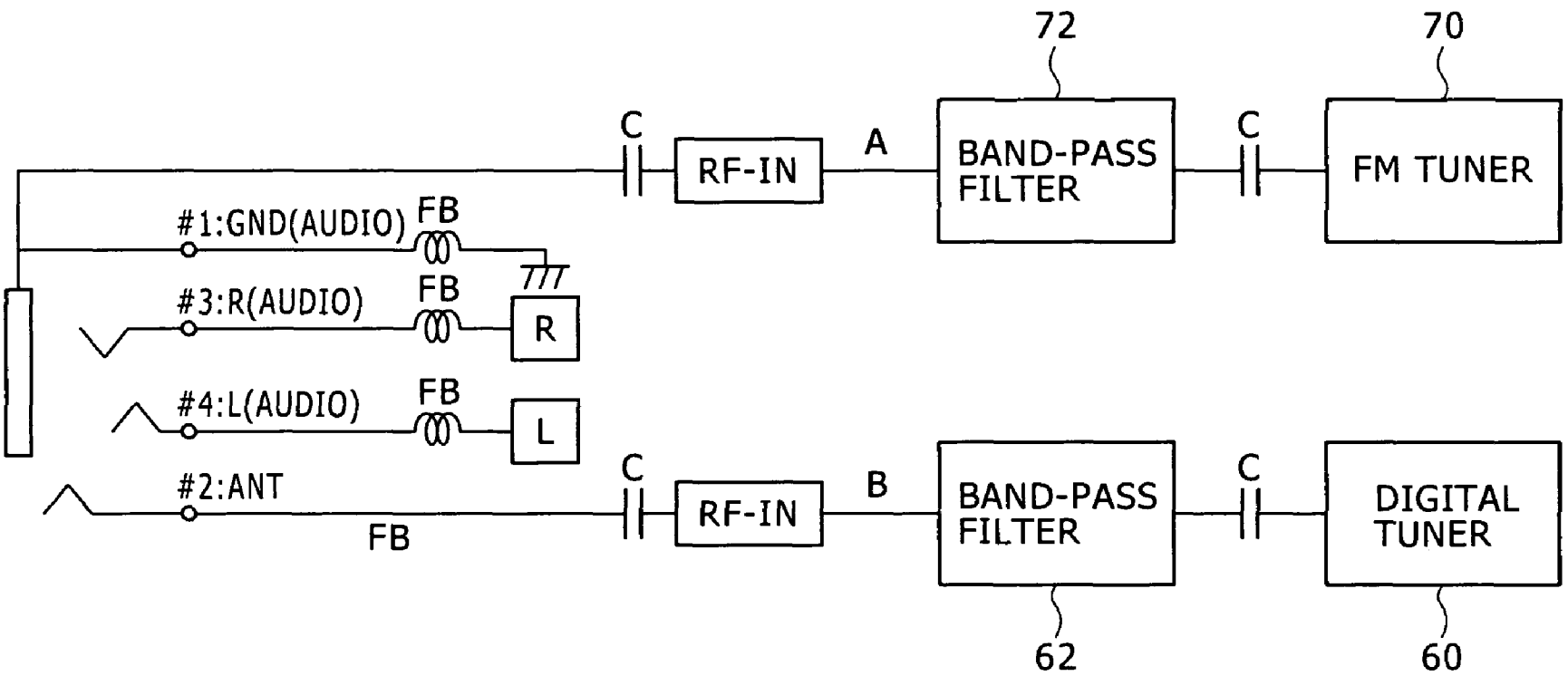
FIG. 6 is a diagram showing an example of configuration of a tuner peripheral circuit when a digital tuner 60 and an FM tuner 70 perform receiving operation simultaneously and in parallel with each other.

In the configuration of the tuner side shown in FIG. 3, only one of the digital tuner 60 and the FM tuner 70 performs receiving operation, and the high-frequency changing switch 80 alternatively sets the antenna feeding position. However, the digital tuner 60 and the FM tuner 70 may perform receiving operation simultaneously and in parallel with each other. FIG. 6 shows an example of configuration of a tuner peripheral circuit of the receiving terminal in this case.

On the tuner side, high-frequency chokes (ferrite beads: FB) having a low impedance in the frequency region of audio signals and having a high impedance in the frequency region of high-frequency signals are respectively loaded on the transmission lines for transmitting the left and right audio signal lines and the ground line. In addition, capacitors C having a high impedance in the frequency region of the audio signals and having a low impedance in the frequency region of the high-frequency signals are respectively loaded on the transmission lines for transmitting antenna received signals received from the core line 11 and the outer covering conductor 13.

The antenna received signals are input to the digital tuner 60 and the FM tuner 70 via band-pass filters 62 and 72 passing the UHF band and the VHF band, respectively.

Figure 7:
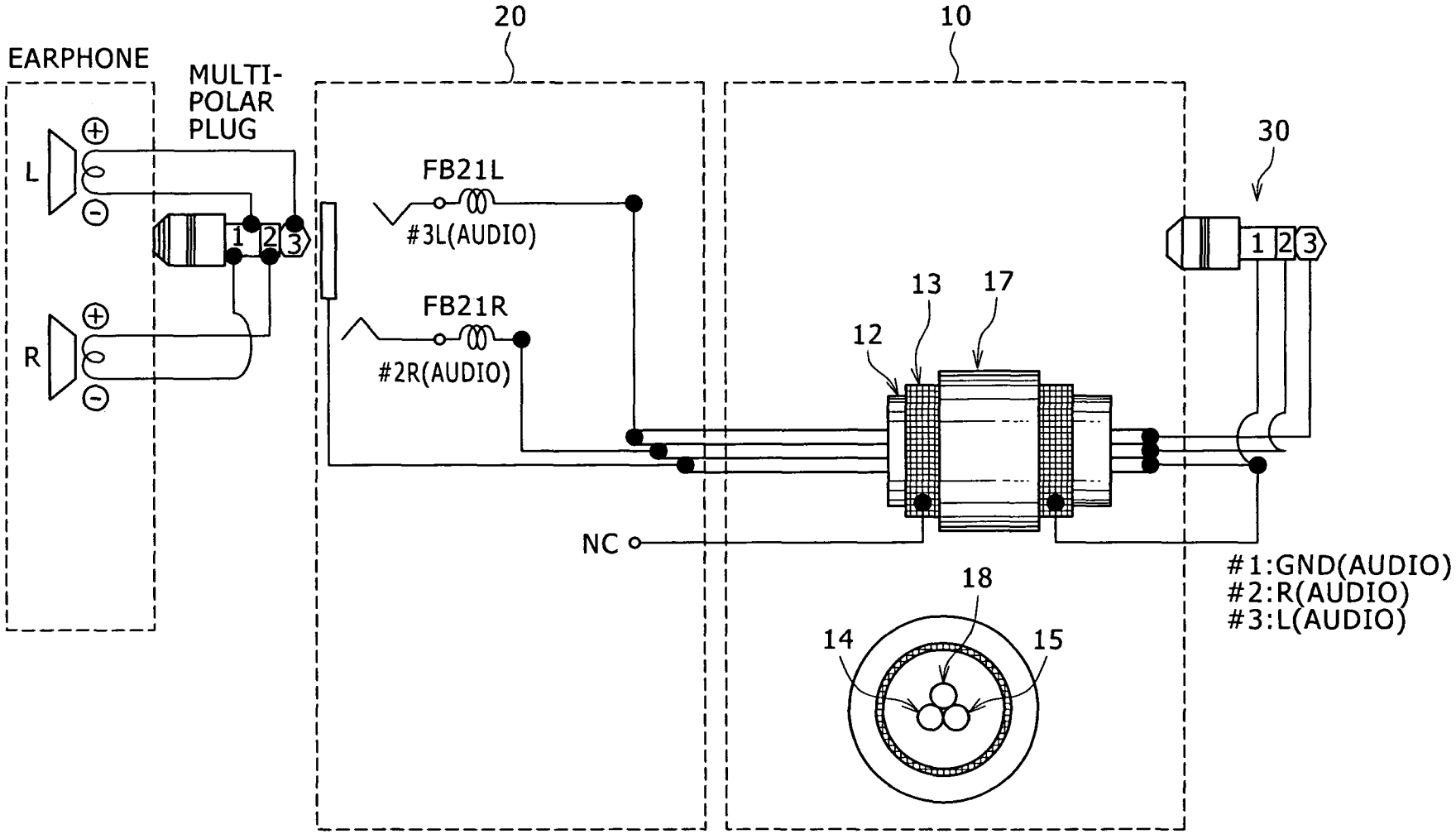
FIG. 7 is a diagram showing another example of configuration of the antenna element.

FIG. 7 shows another example of configuration of the antenna element.

An earphone cable is formed by bundling together three signal lines running in parallel with each other, that is, two insulation-coated audio signal lines for supplying an audio signal to a left earphone and a right earphone, and a ground line. At the base end of the earphone cable, the ground line and the right and left audio signal lines are assigned to pins #1, #2, and #3, respectively, of a three-pole plug (same as the above).

An antenna element cable 10 includes a coaxial cable formed by covering a central axis line of a twisted wire structure obtained by twisting together insulation-coated signal lines 14 and 15 for the left and right audio signals and a ground line 18 for the audio signals with an inside insulator 12 and further covering the inside insulator 12 with an outer covering conductor 13. The present inventors et al. consider that the coaxial cable is suitable as an antenna element cable also serving as an earphone cable (same as the above).

A relay board 20 including a three-pole jack for receiving the three-pole plug of the earphone cable is disposed at the leading end of the antenna element cable 10. The relay board 20 has high-frequency chokes 21L and 21R loaded on the left and right audio signal lines 14 and 15 connected to the pins #1 and #2 of the three-pole plug, the high-frequency chokes 21L and 21R having a low impedance in the frequency region of the audio signals and having a high impedance in the frequency region of high-frequency signals, and the high-frequency chokes 21L and 21R being formed by ferrite beads, for example (same as the above). In addition, the relay board 20 connects the ground line for the audio signals on the earphone cable side to the ground signal line 18 via the pin #3 of the three-pole plug. Further, the outer covering conductor 13 of the coaxial cable is set in a non-connected (NC) state in the relay board 20.

When a feeding position is set so as to make the ground line 18 for the audio signals transmit a high-frequency signal, the ground lines of the earphone cable and the antenna element cable are used together as an aerial and operate as a sleeve antenna structure resonating at a line length of the aerial, so that a UHF band (470 MHz to 770 MHz) can be received.

On the other hand, when the feeding position is set so as to make the outer covering conductor 13 of the coaxial cable transmit a high-frequency signal, the outer covering conductor 13 of the coaxial cable is used as an aerial and operates as a monopole antenna structure resonating at a line length of the aerial, so that a VHF band or an FM radio band (70 MHz to 90 MHz) can be received.

A three-pole plug 30 to be inserted into a receiving terminal, that is, a tuner side is disposed at the base end of the antenna element cable 10. Pins #3 and #2 of the three-pole plug 30 are assigned to the left and right audio signal lines 14 and 15. A pin #1 of the three-pole plug 30 is assigned to the outer covering conductor 13 and the ground line 18. When the antenna device operates as a sleeve antenna, the ground line 18 of the coaxial cable and the ground line of the earphone cable constitute an antenna element. When the antenna device operates as a monopole antenna, the outer covering conductor 13 of the coaxial cable forms an antenna element.

Figure 8:
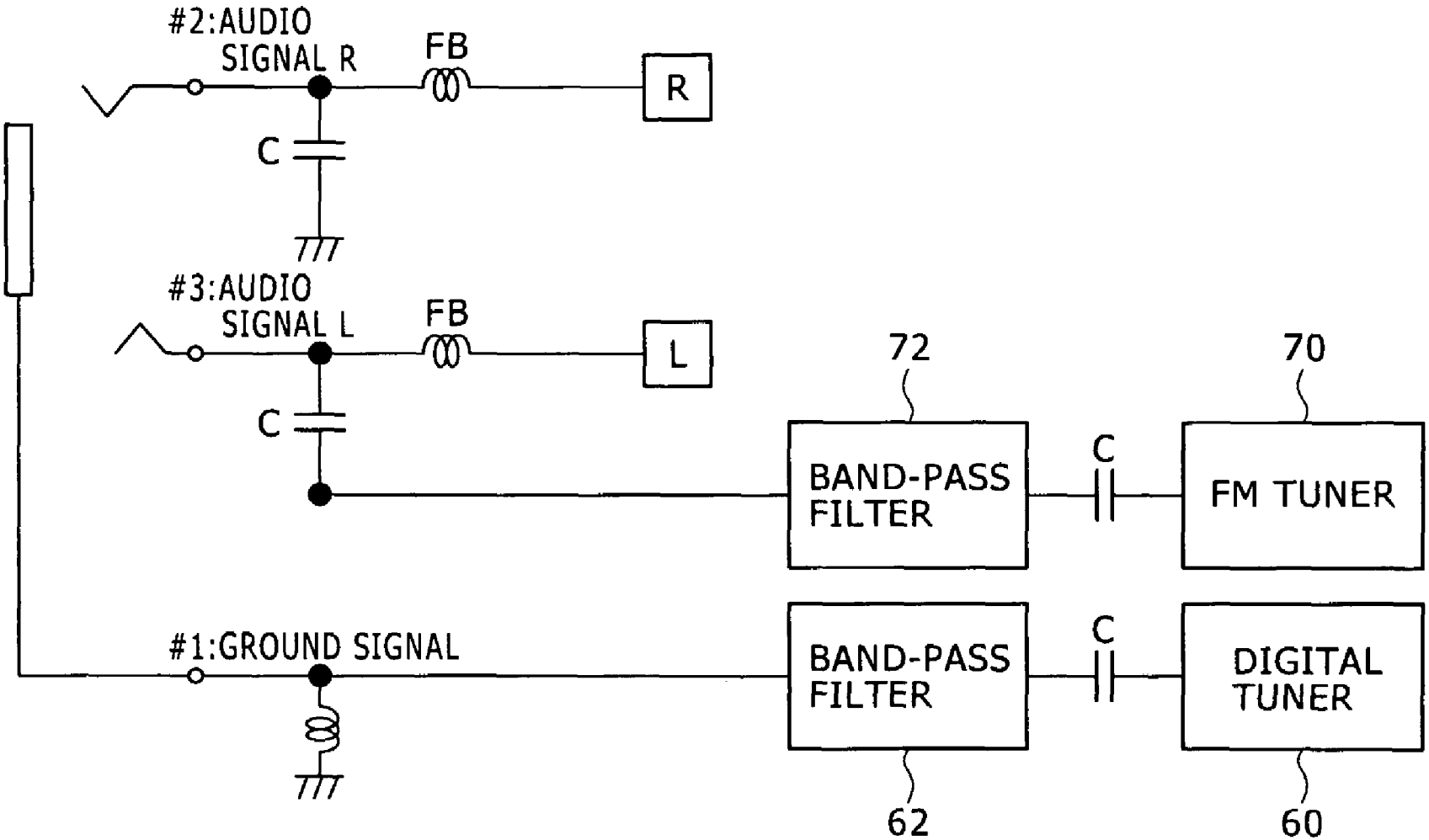
FIG. 8 is a diagram showing an example of configuration of a tuner peripheral circuit of a receiving terminal into which the antenna element shown in FIG. 7 can be inserted.

FIG. 8 shows an example of configuration of a tuner peripheral circuit of the receiving terminal into which the antenna element shown in FIG. 7 can be inserted.

The receiving terminal side including tuners has a three-pole jack for receiving the three-pole plug 30 at the base end of the antenna element cable 10. High-frequency chokes (ferrite beads: FB) having a low impedance in the frequency region of the audio signals and having a high impedance in the frequency region of the high-frequency signals are respectively loaded on the transmission lines for transmitting the left and right audio signal lines. Then, the transmission line for transmitting one of the left and right audio signals (left side in the example shown in FIG. 8) is branched, and a capacitor C having a high impedance in the frequency region of the audio signals and having a low impedance in the frequency region of the high-frequency signals is loaded on the branch line. Further, capacitors C having a high impedance in the frequency region of the audio signals and having a low impedance in the frequency region of the high-frequency signals are loaded on the transmission lines for transmitting antenna received signals received from the ground line 18 and the outer covering conductor 13 within the coaxial cable.

The receiving terminal includes: a digital tuner 60 for receiving terrestrial digital broadcast waves using the UHF band; and an FM tuner 70 for receiving FM radio broadcast waves using the VHF band. The FM tuner 70 can receive a high-frequency signal in the FM radio band from the left-side audio signal via the capacitor C. The digital tuner 60 can receive a high-frequency signal in the UHF band from the ground line 18 and the outer covering conductor 13 within the coaxial cable via the capacitor C.

The present invention has been explained above in detail with reference to specific embodiments thereof. It is obvious, however, that modifications and substitutions in the embodiments can be made by those skilled in the art without departing from the spirit of the present invention.

In the present specification, description has been made centering on the embodiments applied to a receiving terminal performing multiple tuning to terrestrial digital broadcasting and FM radio broadcasting. However, the spirit of the present invention is not limited to this, and the present invention is similarly applicable to combinations of other required frequency bands.

In short, the present invention has been disclosed in a form that is illustrative and contents described in the present specification are not to be construed in a restrictive manner. In order to determine the spirit of the present invention, claims are to be considered.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna device for receiving a broadcast wave in each of a first frequency band and a second frequency band, said antenna device comprising:

a relay circuit, and a base end of an antenna element cable connected to a device;

wherein said relay circuit connects a core line of a coaxial line to a ground line, and sets an outer covering conductor of said coaxial line in a non-connected state, and an antenna switching circuit performs switching to make the core line of said coaxial line transmit a high-frequency signal in an operation mode in which reception is performed in the first required frequency band, whereby an earphone cable and the core line of said coaxial line are used as an aerial and operate as a sleeve antenna structure, and said antenna switching circuit performs switching to make the outer covering conductor of said coaxial line transmit a high-frequency signal in an operation mode in which reception is performed in the second required frequency band, whereby the outer covering conductor of said coaxial line is used as an aerial and operates as a monopole antenna structure.

2. The antenna device as claimed in claim 1, wherein said relay circuit has a high-frequency choke loaded on an audio signal line, the high-frequency choke having a low impedance in a frequency band of an audio signal and a high impedance in a frequency band of a high-frequency signal.

3. The antenna device as claimed in claim 1, wherein said antenna switching circuit has a capacitor loaded on each of signal lines for the core line and the outer covering conductor of said coaxial line, the capacitor having a high impedance in a frequency band of an audio signal and a low impedance in one of the first required frequency band and the second required frequency band, and connects the signal lines to a side of said tuner.

4. The antenna device as claimed in claim 1, wherein within said antenna element cable, said audio signal line is disposed outside said coaxial cable.

5. The antenna device as claimed in claim 1, wherein within said antenna element cable, said audio signal line is covered as an insulation-coated signal line together with said core line by said insulator and said outer covering conductor.

6. The antenna device as claimed in claim 1, wherein said first required frequency band is a Ultra High Frequency (UHF) band, and said second required frequency band is a Very High Frequency (VHF) band.

7. The antenna device as claimed in claim 1, wherein a base end of said earphone antenna is formed by a multipolar plug and is allowed to be inserted into and detached from a multipolar jack disposed in the relay circuit on a side of said antenna cable, and a base end of said antenna cable is formed by a multipolar plug and is allowed to be inserted into and detached from a tuner device including said antenna switching circuit.

8. A receiving terminal comprising:

an antenna element cable including a coaxial line formed by covering a core line with an insulator and further covering the insulator with an outer covering conductor, and an audio signal line, a leading end of the antenna element cable being connected to an earphone cable including an audio signal line and a ground line via a relay circuit, the relay circuit connecting the core line of said coaxial line to the ground line on a side of said earphone cable, and setting the outer covering conductor of said coaxial line in a non-connected state;

tuners for performing receiving operation in a first required frequency band and a second required frequency band, respectively; and an antenna switching circuit for changing constitution of an antenna formed by said earphone cable and said antenna element cable by changing a feeding position in said inserting unit according to which of the tuner performs the receiving operation.

9. The receiving terminal as claimed in claim 8, wherein said antenna switching circuit performs switching to make the core line of said coaxial line transmit a high-frequency signal in an operation mode in which reception is performed in the first required frequency band, whereby said earphone cable and the core line of said coaxial line are used as an aerial and operate as a sleeve antenna structure resonating at a line length of the aerial, and said antenna switching circuit performs switching to make the outer covering conductor of said coaxial line transmit a high-frequency signal in an operation mode in which reception is performed in the second required frequency band, whereby the outer covering conductor of said coaxial line is used as an aerial and operates as a monopole antenna structure resonating at a line length of the aerial.

10. The receiving terminal as claimed in claim 8, wherein said antenna switching circuit has a capacitor loaded on each of signal lines for the core line and the outer covering conductor of said coaxial line, the capacitor having a high impedance in a frequency band of an audio signal and a low impedance in one of the first required frequency band and the second required frequency band, and connects the signal lines to a side of said tuner.

11. The receiving terminal as claimed in claim 8, wherein said first required frequency band is a UHF band, and said second required frequency band is a VHF band.

12. A receiving terminal comprising:

an inserting unit into which an antenna element cable is detachably inserted, the antenna element cable including a coaxial line formed by covering a core line with an insulator and further covering the insulator with an outer covering conductor, and an audio signal line, a leading end of the antenna element cable being connected to an earphone cable including an audio signal line and a ground line via a relay circuit, the relay circuit connecting the core line of said coaxial line to the ground line on a side of said earphone cable, and setting the outer covering conductor of said coaxial line in a non-connected state;

a first turner and a second tuner for performing receiving operation in a first required frequency band and a second required frequency band;

a first band-pass filter for passing the first required frequency band, the first band-pass filter being loaded between a sleeve antenna using said earphone cable and the core line of said coaxial line as an aerial and the first tuner; and a second band-pass filter for passing the second required frequency band, the second band-pass filter being loaded between a monopole antenna using the outer covering conductor of said coaxial line as an aerial and the second tuner.

13. The receiving terminal as claimed in claim 12, wherein said first required frequency band is a UHF band, and said second required frequency band is a VHF band.

* * * * *